US005557392A

United States Patent [19]

Iwata

[11] Patent Number: 5,557,392

[45] **Date of Patent: *Sep. 17, 1996**

[54] MULTICOLOR IMAGE FORMING APPARATUS WITH PULSE VOLTAGE AND DC VOLTAGE APPLIED TO A DEVELOPING UNIT

[75] Inventor: Naoki Iwata, Tokyo, Japan

[73] Assignee: Ricoh Company, Ltd., Tokyo, Japan

[ * ] Notice: The term of this patent shall not extend beyond the expiration date of Pat. No. 5,450,172.

[21] Appl. No.: 169,078

[22] Filed: Dec. 20, 1993

[30] Foreign Application Priority Data

Dec. 22, 1992 [JP] Japan ..... 4-356708

[51] Int. Cl.[6] ..... G03G 15/01

[52] U.S. Cl. ..... 355/326 R; 355/246

[58] Field of Search ..... 355/245, 246, 355/247, 326 R, 327, 251, 253, 259, 260; 118/653, 656, 658, 645

[56] References Cited

U.S. PATENT DOCUMENTS

| | | | |
|---|---|---|---|
| 4,791,452 | 12/1988 | Kasai et al. | 355/326 R |
| 4,809,038 | 2/1989 | Yamamoto et al. | 118/645 X |
| 4,887,102 | 12/1989 | Yoshikawa et al. | 355/246 X |
| 4,937,629 | 6/1990 | Maruyama et al. | 355/246 X |
| 4,937,630 | 6/1990 | Yoshikawa et al. | 355/245 X |
| 4,947,212 | 8/1990 | Ikegawa et al. | 355/326 R X |
| 5,003,351 | 3/1991 | Waki et al. | 355/245 |
| 5,030,996 | 7/1991 | Tajima et al. | 355/246 |
| 5,066,979 | 11/1991 | Goto et al. | 355/245 X |
| 5,115,282 | 5/1992 | Higashio | 355/246 X |
| 5,187,535 | 2/1993 | Tajima | 355/326 R |
| 5,202,731 | 4/1993 | Tanikawa et al. | 355/251 |
| 5,212,524 | 5/1993 | Tanikawa et al. | 355/251 |
| 5,241,357 | 8/1993 | Iwata | 355/326 R |
| 5,276,487 | 1/1994 | Akinaga et al. | 355/245 |
| 5,305,069 | 4/1994 | Nakano | 355/326 R |
| 5,307,127 | 4/1994 | Kobayashi et al. | 355/259 |
| 5,338,894 | 8/1994 | Uchiyama et al. | 118/653 |
| 5,450,172 | 9/1995 | Suzuki et al. | 355/326 R |

*Primary Examiner*—Arthur T. Grimley
*Assistant Examiner*—Shuk Yin Lee
*Attorney, Agent, or Firm*—Oblon, Spivak, McClelland, Maier & Neustadt, P.C.

[57] ABSTRACT

In an image forming apparatus of the type forming a multicolor toner image on an image carrier and then transferring it to a transfer medium at a time, a first developing unit develops a latent image with a developer of first color while a second developing unit develops a latent image with a developer of second color. The second developing unit has a developer carrier for depositing the developer of second color thereon, and a bias power source for applying to the developer carrier a bias voltage for development which changes periodically and has one period made up of a first and a second period of time. During the first period of time, the bias power source applies to the developer carrier a first voltage generating an electric field which causes the developer to fly toward the image area and non-image area of the image carrier in a gap between the image carrier and the developer carrier. During the second period of time, the power source applies a second voltage generating, in the gap, an electric field returning the developer having flied toward the non-image area during the first period of time to the developer carrier while preventing the developer of first color existing on the image carrier from leaving the image carrier. The first period of time is selected such that the developer of second color does not reach the non-image area and the developer of first color existing on the image carrier does not fly to the developer carrier.

13 Claims, 13 Drawing Sheets

MULTICOLOR IMAGE FORMING APPARATUS WITH PULSE VOLTAGE AND DC VOLTAGE APPLIED TO A DEVELOPING UNIT

BACKGROUND OF THE INVENTION

1. Field of the Invention

The present invention relates to a copier, facsimile apparatus, printer or similar image forming apparatus and, more particularly, to an image forming apparatus of the type forming a multicolor visible image or toner image on an image carrier and then transferring it to a transfer medium at a time.

2. Discussion of the Background

An image forming apparatus of the type forming a multicolor toner image on an image carrier with developers of different colors is conventional. It has been customary with this type of apparatus to use, as a developer for developing a latent image of second color, a non-magnetic toner or one component type developer which colors easily and promotes a small size and low cost configuration. Such a toner is deposited in a layer on a developer carrier which faces, but does not contact, an image carrier. With this arrangement, it is possible to develop a latent image of second color without disturbing a toner image of first color existing on the image carrier.

Specifically, the above-described type of apparatus may be constructed as follows. A plurality of developing means are arranged around an image carrier. Among them, first developing means assigned to a first color stores a two component type developer containing a chromatic toner. Second developing means assigned to a second color is located downstream of the first developing means and loaded with a black one component type developer, i.e., black toner. The black toner is opposite in polarity to the toner of the first developing means. The toner of the second developing means forms a 30 μm to 500 μm thick layer on a developer carrier and is held out of contact with the image carrier. In the event of development, the developer carrier of the second developing means is applied with an AC bias voltage of the kind generating an AC electric field which causes the toner to develop a latent image. On the other hand, when the second developing means is out of operation, a bias voltage of the kind generating an electric field which causes the chromatic toner of the first developing means to develop a latent image is applied to the developer carrier of the second developing means. This kind of arrangement taught in, for example, Japanese Patent Laid-Open Publication (Kokai) No. 63-60471.

However, the problem with the above-described conventional apparatus is that the AC bias voltage for the development in the second color causes the toner of second color to move back and forth between the surface of the image carrier and that of the developer carrier while hitting against the former surface, disturbing the toner image of first color existing on the image carrier. Moreover, the toner of first color also moves back and forth together with the toner of second color while hitting against the surface of the developer carrier. As a result, the toner of first color is introduced into the second developing means, making the toner of second color turbid.

To prevent toners of different colors from being mixed together, a DC bias voltage may be applied in the event of development in the second color so as to cause the non-magnetic toner to fly toward the image carrier, as proposed in the past. Specifically, this kind of approach uses an image carrier having a photoconductive layer made of selenium or arsenic selenide. The photoconductive layer is 35 μm to 90 μm thick and has an electrostatic capacity of 20 pF/cm$^2$ to 170 pF/cm$^2$. A plurality of developing means are arranged around the image carrier. Charging, exposing and developing steps are repeated a plurality of times to form a multicolor image on a single image carrier. In second developing means assigned to a second color, a developer carrier is spaced less than 250 μm from the image carrier and has applied thereto a DC bias voltage to effect non-contact development. At this instant, the other developer carriers not contributing to development are not driven to prevent the toners of different colors from being mixed. This type of apparatus is disclosed in Japanese Kokai No. 63-63061 by way of example. Kokai No. 63-63061 includes an embodiment using an image carrier having a 15 μm to 50 μm thick organic photoconductor layer, a scorotron charger, a reversal development procedure, a potential contrast of higher than 400 V, and a 5 μm to 30 μm thick toner layer deposited on the image carrier.

An image forming apparatus of the type forming a multicolor image with a plurality of developing means adjoining, but not contacting, a recording medium is also known in the art. In first or upstream development means, a developer carrier is applied with a DC-biased AC voltage and rotated in the same direction as and at a higher peripheral speed than the recording medium for effecting development in black. Downstream or second developing means and successive developing means are each applied only with a DC voltage and operated at equal speed to perform color development. For this type of apparatus, a reference may be made to Japanese Kokai No. 63-85578 by way of example. However, when the toner is caused to fly by an electric field generated by a DC bias voltage, the cohered toner is locally omitted in low contrast portions, resulting in a critically granular image. Moreover, in the line portions of a latent image, the edge electric field of the latent image turns round to the image carrier, preventing thin lines from being reproduced.

SUMMARY OF THE INVENTION

It is, therefore, an object of the present invention to provide an image forming apparatus capable of reproducing a sharp multicolor image, in which low contrast portions are smooth and thin lines are clear-cut, without disturbing a toner image existing on an image carrier during the course of second and successive development, while preventing toners of different colors from being mixed in the following developing means.

In accordance with the present invention, in an image forming apparatus of the type forming a multicolor toner image on an image carrier and then transferring it to a transfer medium at a time, a first developing unit develops a latent image with a developer of first color while a second developing unit develops a latent image with a developer of second color. The second developing unit has a developer carrier for depositing the developer of second color thereon, and a bias power source for applying to the developer carrier a bias voltage for development which changes periodically and has one period made up of a first and a second period of time. During the first period of time, the bias power source applies to the developer carrier a first voltage generating an electric field which causes the developer to fly toward the image area and non-image area of the image carrier in a gap between the image carrier and the developer carrier. During the second period of time, the power source applies a second voltage generating, in the gap, an electric field returning the developer having flied toward the non-image area during the first period of time to the developer carrier while preventing the developer of first color existing on the image carrier from leaving the image carrier. The first period of time is selected such that the developer of second color does not reach the non-image area and the developer of first color existing on the image carrier does not fly to the developer carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
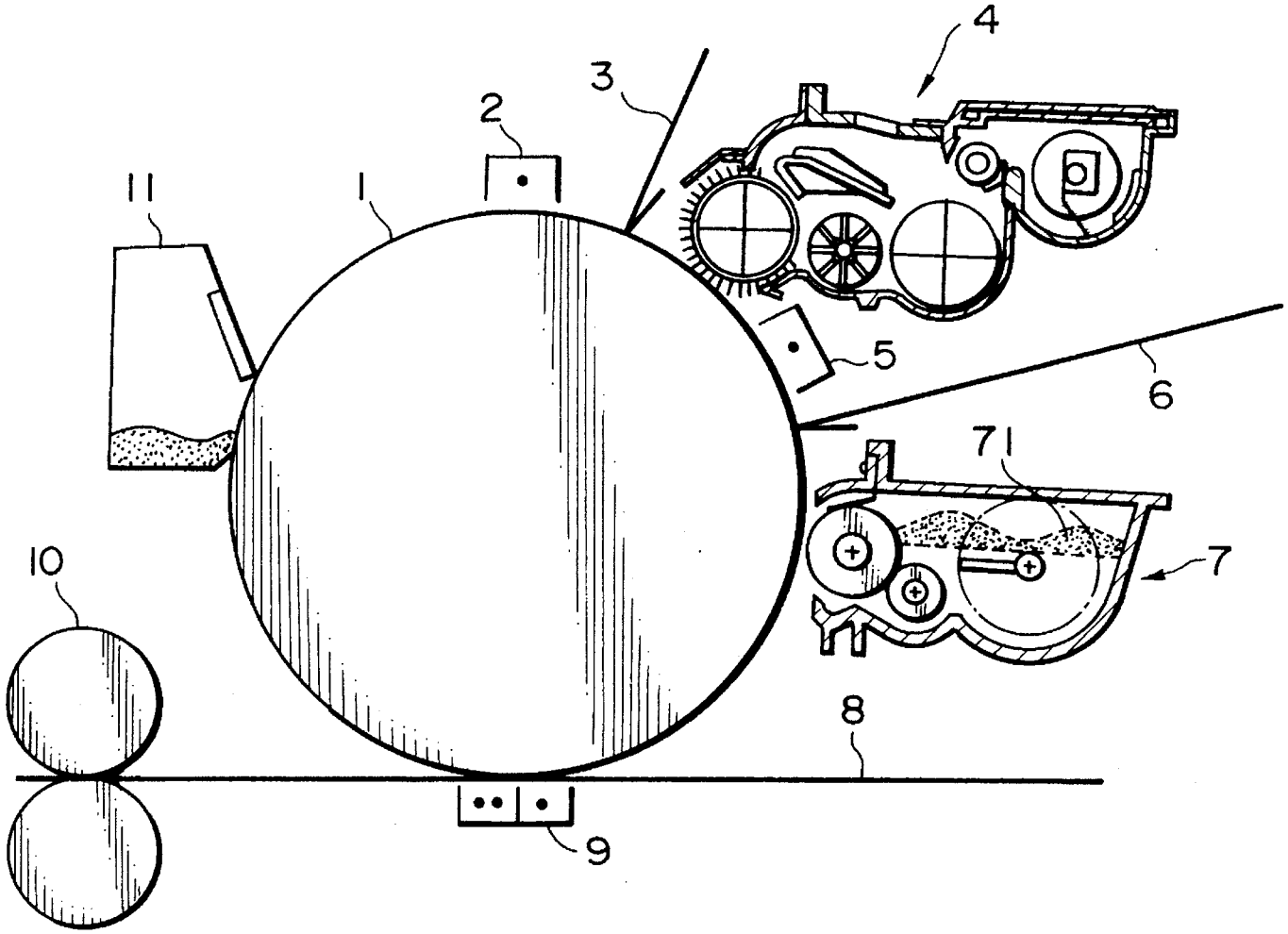
FIG. 1 is a section showing an image forming apparatus embodying the present invention and implemented as a copier.

Referring to FIG. 1 of the drawings, a multicolor image forming apparatus embodying the present invention is shown and implemented as a multicolor copier by way of example. As shown, the copier has a photoconductive element, or image carrier, 1 forming the surface of a photoconductive drum. Developing units 4 and 7 store respectively a developer of first color and a developer of second color which are chargeable to the same polarity as the photoconductive element, or drum as referred to hereinafter, 1. The developing units 4 and 7 each play the role of developing means of the type effecting negative-to-positive development.

Figure 3A:
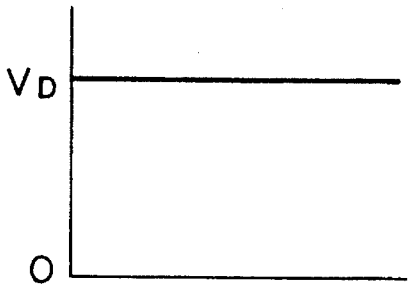
FIGS. 3A, 3B, 3C, 3D, 3E, and 3F demonstrate a sequence of steps particular to the embodiment.
Figure 3B:
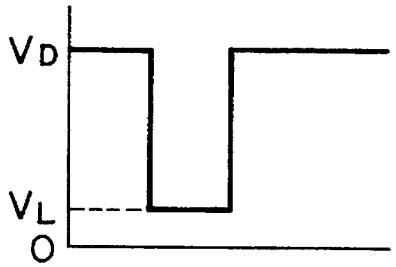
Figure 3C:
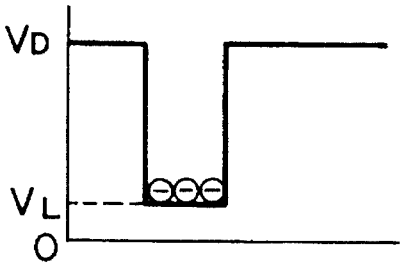
Figure 3D:
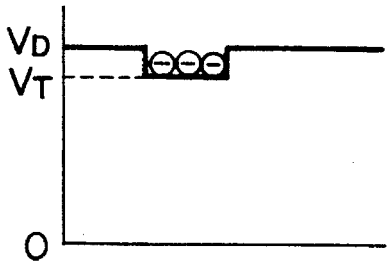
Figure 3E:
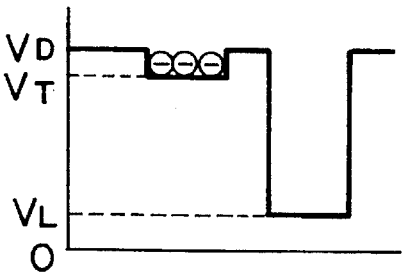
Figure 3F:
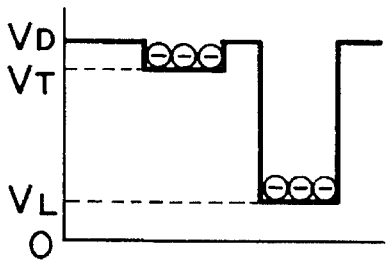

The operation of the copier will be outlined with reference to FIGS. 3A–3F as well as to FIG. 1. To begin with, as shown in FIG. 3A, a first charger 2 uniformly charges the surface of the drum 1 to a potential $V_D$. Then, a first exposing device 3 forms a first electrostatic latent image on the drum 1. As a result, as shown in FIG. 3B, the potential of the drum 1 corresponding to the latent image is lowered to $V_L$. As the first developing unit 4 develops the first latent image, the toner of first color is deposited on the drum 1 to form a first toner image, as shown in FIG. 3C. Subsequently, a second charger 5 again charges the surface of the drum 1 over the first toner image to thereby restore the potential of the exposed portion of the drum 1 to one substantially equal to the surrounding potential, as shown in FIG. 3D; the resulting surface potential of the first toner image is $V_T$ slightly lower than $V_D$. Thereafter, a second exposing device 6 forms a second electrostatic latent image on the drum 1, as shown in FIG. 3E, and then the second developing unit 7 develops it with the developer of second color, as shown in FIG. 3F.

By the above procedure, a composite toner image is formed on the drum 1 in two or more colors. Such a multicolor image is collectively transferred by a transfer device 9 from the drum 1 to a paper 8 being transported on a predetermined transport path. A fixing unit 10 fixes the toner image on the paper 8 to complete a multicolor image. The toner particles left on the drum 1 after the image transfer are scraped off by a cleaning unit 11, whereby the drum 1 is prepared for the next image forming cycle.

Figure 4:
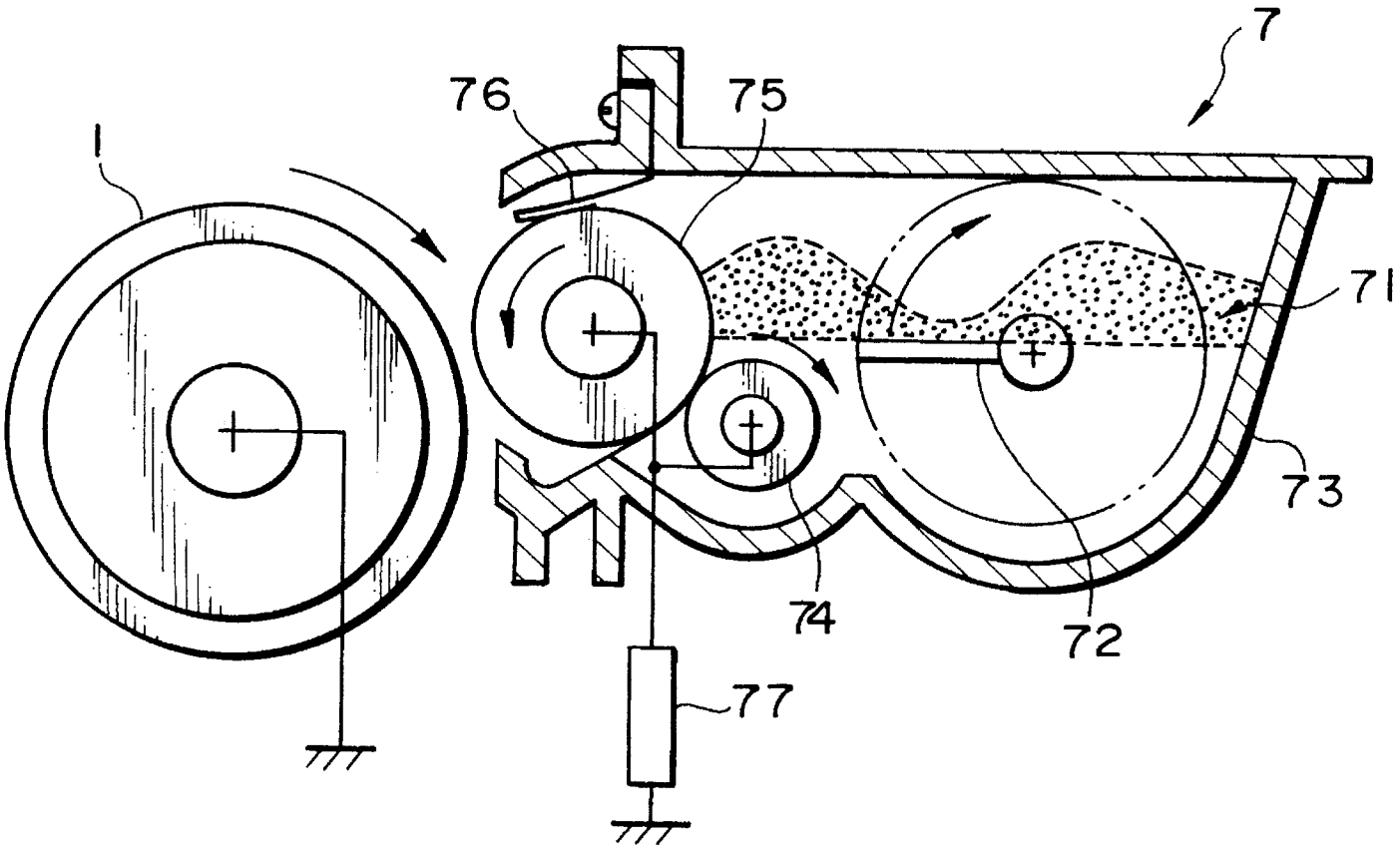
FIG. 4 is a section showing a developing unit included in the embodiment.

As shown in FIG. 4, the developer of second color stored in the developing unit 7 is implemented as a toner, or nonmagnetic one component type developer, 71. The developing unit 7 is made up of a hopper 73 accommodating an agitator 72 therein, a toner supply member 74, a developing roller or developer carrier 75, a toner regulating member 76 for forming a toner layer on the roller 75, a bias power source or bias applying means 77, etc. The toner 71, which is different in color from the developer of first color, is supplemented to the hopper 73 and agitated by the agitator 72. The toner 71 is fed from the hopper 73 to the toner supply member 74 and then frictionally charged by the member 74 and developing roller 75. As a result, the toner 71 is deposited on the developing roller 75. While the developing roller 75 conveys the toner 71 to a developing region where it faces the drum 1, the toner regulating member 76 levels the toner 71 to form a uniform toner layer on the roller 75. The developing roller 75 carrying the toner layer thereon faces the drum 1 without contacting it. The surface of the roller 75 and that of the drum 1 are moved at substantially the same speed as each other and spaced a predetermined distance, preferably 0.1 mm to 0.3 mm, from each other. In the event of development, the bias power source 77 applies a predetermined bias voltage to each of the developing roller 75 and toner supply member.

Figure 5A:
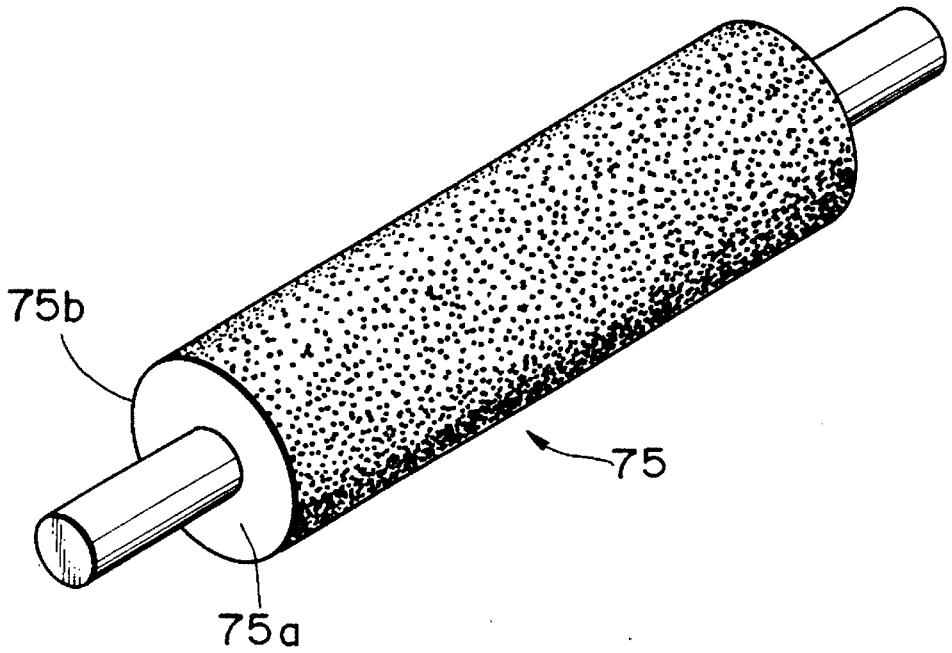
FIG. 5A is an external perspective view of a developing roller incorporated in the developing unit.
Figure 5B:
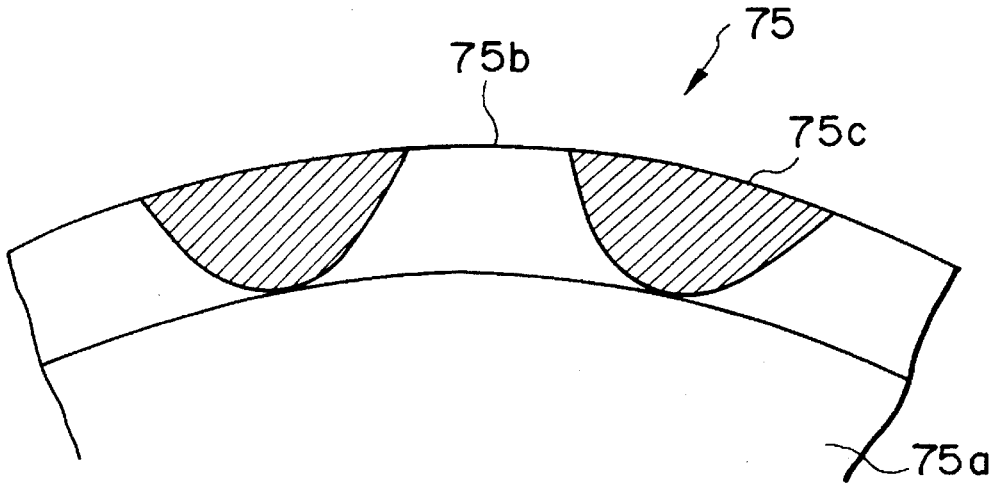
FIG. 5B is a section of the developing roller.

FIGS. 5A and 5B show the developing roller 75 included in the embodiment specifically. As shown, the roller 75 has a roller portion 75*a* as distinguished from a shaft portion (no numeral). The roller portion 75*a* has a surface layer made up of a conductive resin 75*b*, and dielectric particles 75*c* buried in the resin 75*b* and exposed to the outside. The exposed surfaces of the dielectric particles 75*c* are charged by friction so as to form a great number of small closed electric fields. i.e., microfields on the surface of the roller 75. The nonmagnetic toner 71 is deposited on the roller 75 by such micro fields.

Figure 7A:
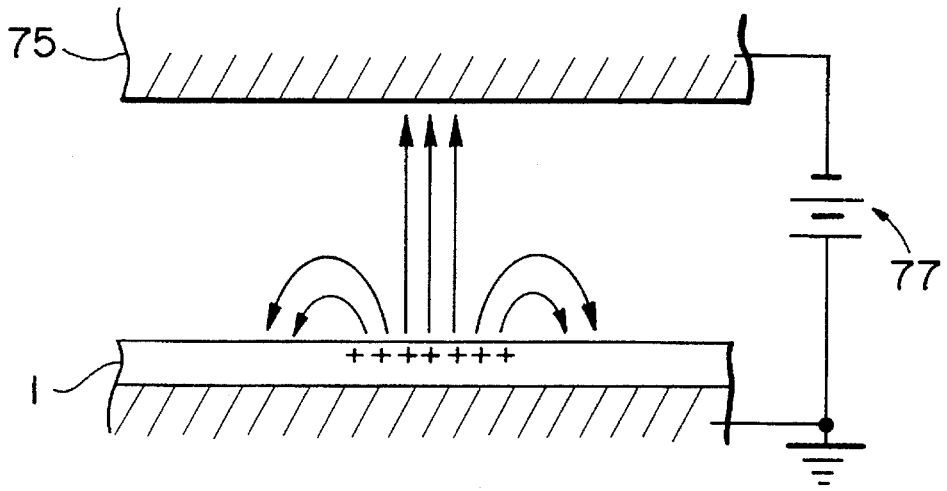
FIG. 7A shows an electric field distribution in the developing gap of the embodiment.
Figure 7B:
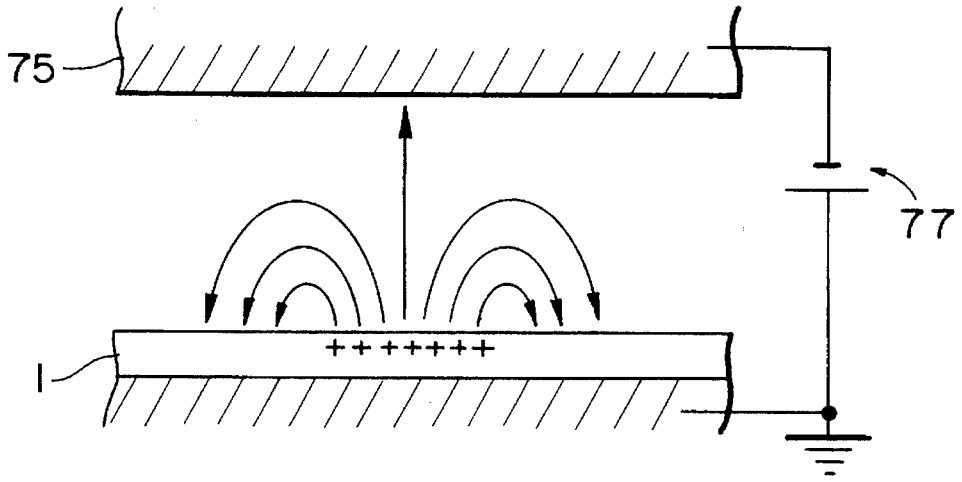
FIG. 7B PRIOR ART
FIG. 7B shows an electric field distribution occurring in a conventional copier.

Assume that the bias voltage to be applied to the developing roller 75 is implemented by an AC voltage. Then, the toner of second color 71 moves back and forth between the surface of the drum 1 and that of the roller 75 while hitting against the former surface, thereby disturbing the toner image of first color. Moreover, the toner of first color moves back and forth together with the toner of second color 71 while hitting against the roller 75. As a result, the toner of first color is introduced into the second developing unit 7, sequentially making the toner 71 turbid. To eliminate this problem, a DC voltage may be applied to the roller 75 as a bias voltage. This, however, brings about another problem that in low contrast portions the cohered toner particles are locally omitted, resulting in a critically granular image. Furthermore, with a DC voltage, it is impossible to reproduce thin lines since the edge electric fields of a latent image turn round to the drum 1 side, as illustrated in FIG. 7B.

Figure 2:
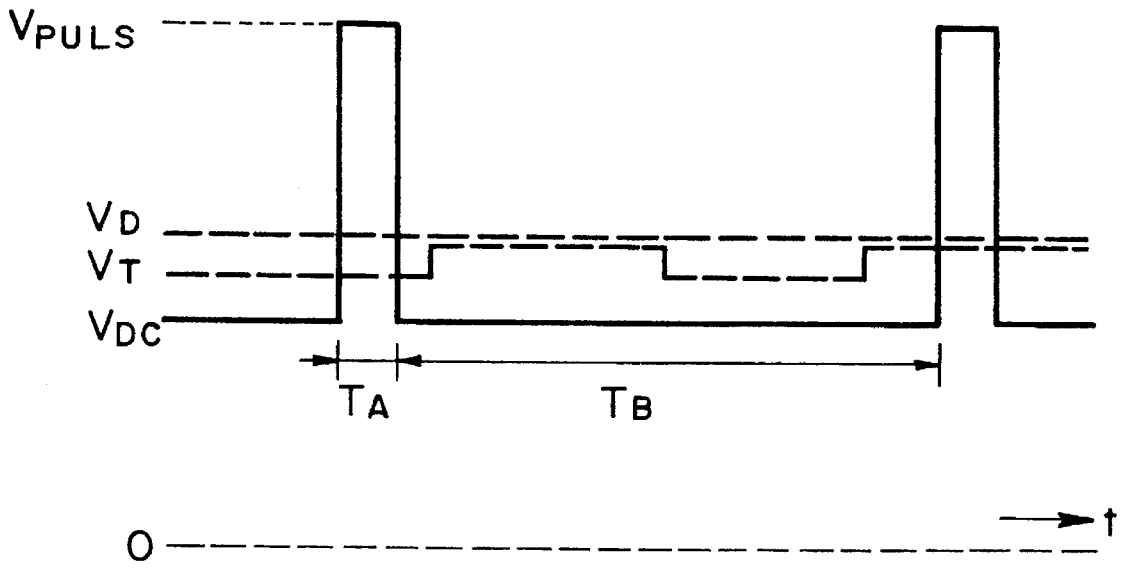
FIG. 2 shows the waveform of a bias voltage for development particular to the embodiment.

In light of the above, when the second developing unit 7 develops a latent image with the toner 71 of second color, the embodiment applies to the developing roller 75 a bias voltage $V_B$ which changes periodically, as shown in FIG. 2. As shown, the bias voltage $V_B$ is made up of a pulse voltage or first voltage $V_{PULS}$ and a DC voltage or second voltage $V_{DC}$. Regarding a single period, the pulse voltage $V_{PULS}$ and the DC voltage $V_{DC}$ are applied to the roller 75 for a first period of time $T_A$ and a second period of time $T_B$, respectively. In FIG. 2, the abscissa indicates time. The pulse voltage $V_{PULS}$ is selected to be greater in absolute value than the potential $V_D$ of the non-image area of the drum 1 so as to increase the developing potential. On the other hand, the DC voltage $V_{DC}$ is selected to be smaller in absolute value than the potential $V_T$ of the toner layer of first color deposited on the drum 1 and the potential $V_D$ of the non-image area and greater in absolute value than the potential $V_L$ of the image area, thereby providing a sufficient developing potential.

When the bias voltage $V_B$ consisting of the DC voltage $V_{DC}$ and the pulse voltage $V_{PULS}$ superposed on $V_{DC}$ is applied to the developing roller 75, the toner 71 flies toward the drum 1, as follows. The movement of the toner 71 in the gap between the roller 75 and the drum 1 (referred to as a developing gap hereinafter) may be expressed by an equation of motion, as follows:

$$m\frac{d^2x}{dt^2} = qE - 6\pi\mu r\frac{dx}{dt} \qquad \text{Eq. (1)}$$

where m is the mass of the toner, x is the distance which the toner moves, t is time, q is the amount of charge deposited on the toner. E is an electric field for development, μ is the viscosity coefficient of air, and r is the radius of the toner.

Figure 6:
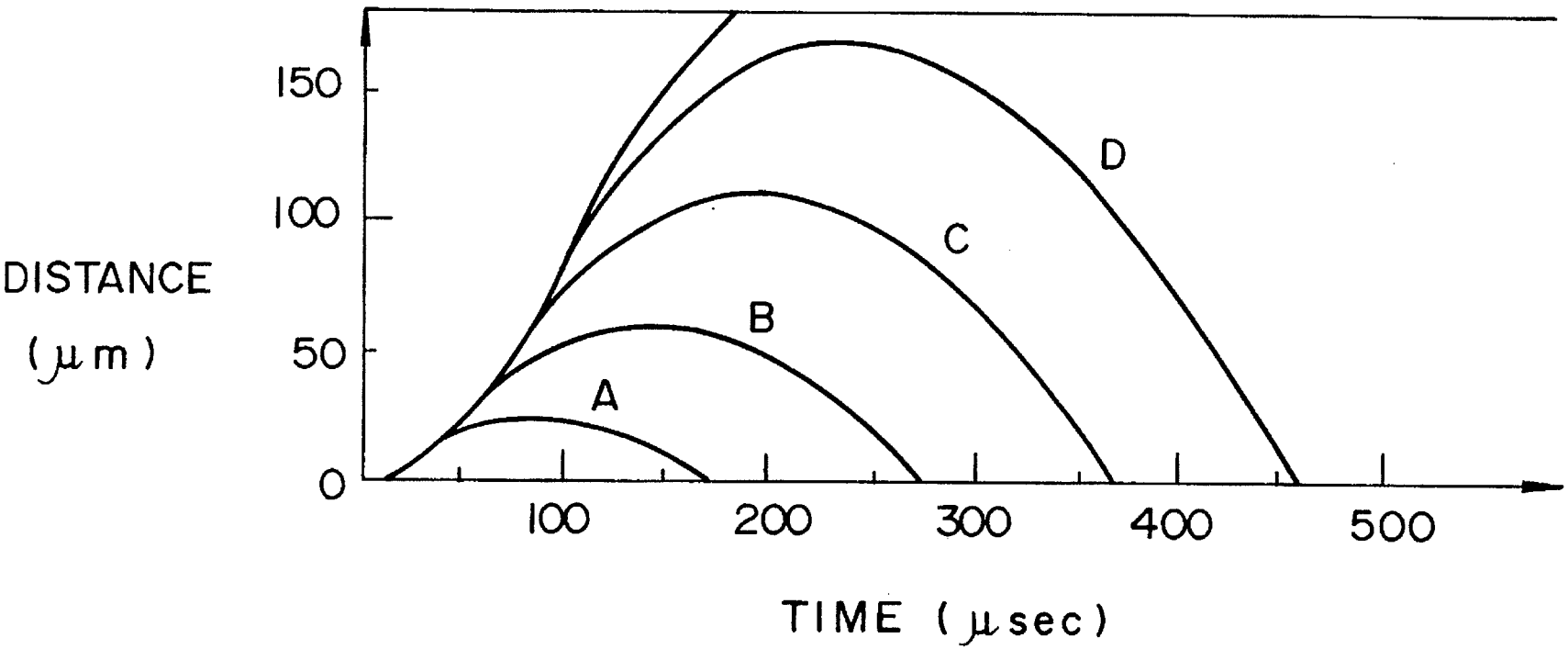
FIG. 6 is a graph indicative of distances which a toner flies in a developing gap, as determined by calculation.

FIG. 6 is a graph indicative of the distance which the toner flies toward the non-image area of the drum 1 with respect to four different durations of application of the pulse voltage $V_{PULS}$, as determined on the basis of the Eq. (1). In FIG. 6, the abscissa and the ordinate indicate time and the distance from the surface of the developing roller 75, respectively. For calculation, the toner was assumed to consist of spherical particles having an average volumetric particle size of 10 μm and a true density of 1 g/cm. Further, the amount of charge deposited on each toner particle was 10 μg, the developing gap was 180 μm, the pulse voltage $V_{PULS}$ was 1200 V, the DC voltage $V_{DC}$ was 700 V, and the potential of the non-image area of the drum 1 was 850 V. Curves A, B, C, D and E shown in FIG. 6 were respectively obtained when the pulse voltage $V_{PULS}$ was applied for 30 μsec, 50 μsec, 70 μsec, 90 μsec, and 100 μsec. As FIG. 6 indicates, the toner reaches the non-image area of the drum 1 when the duration of the pulse voltage $V_{PULS}$ exceeds 100 μsec. Further, experiments conducted under the same conditions showed that when the duration of the pulse voltage $V_{PULS}$ is longer than 100 μsec, the amount of toner to deposit on the background, or non-image area, of the drum 1 sequentially increases, sufficiently matching the results of calculation.

Considering the above, in the embodiment, the pulse voltage $V_{PULS}$ is applied for less than 100 μsec. Also, the bias voltage $V_B$ is provided with a period of longer than 200 μsec. i.e., one period repeats at a frequency lower than 5 kHz. Regarding the period of time $T_B$, the difference between the DC voltage $V_{DC}$ and the potential $V_T$ of the toner layer of first color deposited on the drum 1 ($V_T$–$V_{DC}$, FIG. 2) is selected to be smaller than 500 V. In addition, the developing gap lies in a range of from 100 μm to 300 μm.

In the embodiment described above, when the pulse voltage $V_{PULS}$ is applied for development in the second color, the toner 71 on the developing roller 75 starts flying toward the surface of the drum 1, whether it be an image area or a non-image area. At this instant, an intense electric field is formed in the developing gap, as shown in FIG. 7A. Such an electric field prevents the thickness of a line image from being degraded. Moreover, the toner 71 floating away from the roller 75 flies along the electric field faithfully, insuring desirable reproduction of a thin line.

Figure 8:
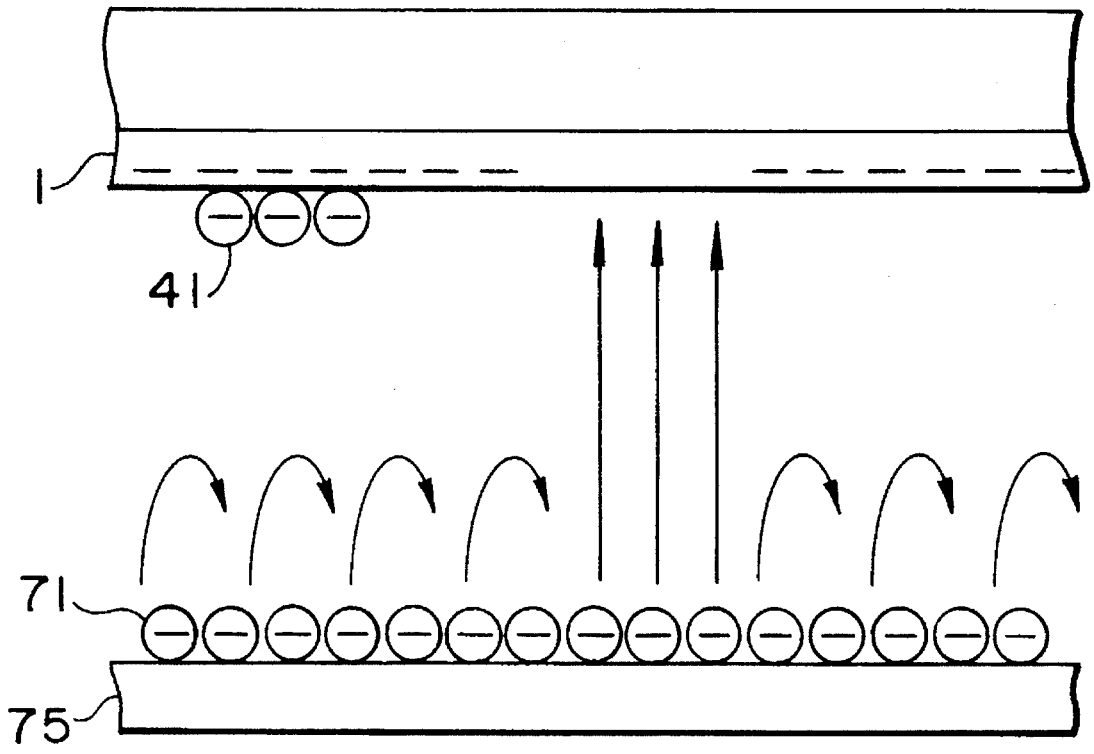
FIG. 8 demonstrates how a toner flies in the developing gap of the embodiment when a DC voltage forming part of a bias voltage is applied.

FIG. 8 shows how the toner 71 flies when the DC voltage $V_{DC}$ is applied to the developing roller 75. As shown, the toner 71 flown toward the non-image area of the drum 1 does not reach the surface of the drum 1, but it is returned to the roller 75. By contrast, the toner 71 flown toward the image area of the drum 1 successfully reaches it, thereby forming a toner image. It is to be noted that the toner 71 shown in FIG. 8 is the toner of second color deposited on the roller 75, while a toner 41 is the toner of first color deposited on the drum 1.

Another advantage achievable with this embodiment is that the toner 71 oscillates on the developing roller 75 and, therefore, become loose or untangled. As a result, a smooth image is formed even in low contrast portions.

In the event of development in the second color, the toner 71 is prevented from moving back and forth in the developing gap while hitting against the surface of the drum 1. The toner 71, therefore, does not disturb the toner image of first color existing on the drum 1. In addition, it is not likely that the toner of first color 41 leaves the drum 1 and flies into the developing unit 7 assigned to the second color.

The repetition frequency of the bias voltage is selected to be lower than 5 kHz, as stated earlier. Hence, when the toner 71 once floated away from the developing roller 75 is returned toward the roller 75, an electric field tending to cause the toner 71 to fly toward the drum 1 is eliminated which would cause it to cloud the developing gap. This is successful in rendering a sharp image.

The developing gap is greater than 100 μm, as also stated earlier. This further prevents the toner of second color 71 from arriving at the non-image area of the drum 1 and, therefore, surely protects the background from contamination. Since the developing gap is smaller than 300 μm, it is not likely that the formation of an electric field for development becomes difficult to render an image unclear.

Moreover, the difference between the DC voltage $V_{DC}$ included in the bias voltage and the potential of the toner image of first color 41 formed on the drum 1 is 500 V. Hence, the toner 41 is prevented from leaving the drum 1 and flying back to the developing roller 75 assigned to the second color.

Figure 9:
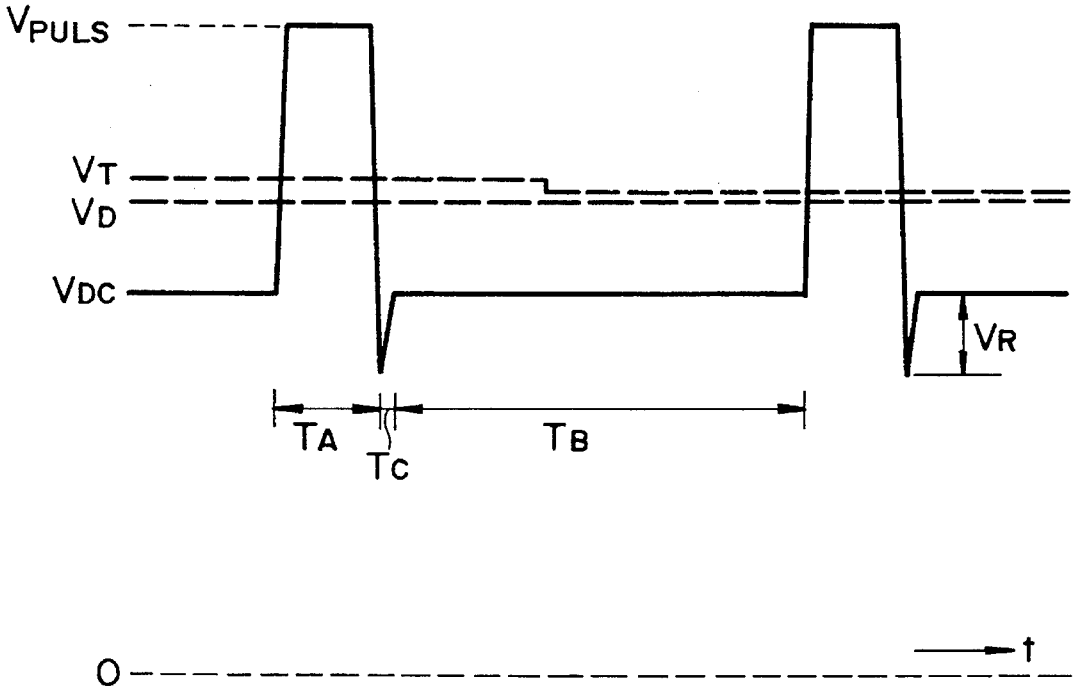
FIGS. 9 and 10 each show the waveform of a bias voltage particular to a modification of the embodiment.

As shown in FIG. 9, the bias voltage $V_B$ for the second color may include an overshoot portion (duration of $T_C$) at the trailing edge of the pulse voltage $V_{PULS}$. The duration $T_C$ of the overshoot is selected to be less than 50 μsec, preferably about 10 μsec to 20 μsec, so as not to affect the toner image of first color existing on the drum 1. The difference VR between the peak voltage of the overshoot portion and the DC voltage $V_{DC}$ is greater than 50 V. When the bias voltage $V_B$ with such an overshoot is applied to the developing roller 75, the toner 71 caused to float away from the roller 75 by the pulse voltage $V_{PULS}$ is decelerated by an inverse electric field sharply generated by the overshoot. As a result, the decelerated toner 71 is returned to the surface of the roller 75 rapidly and, therefore, prevented from clouding the developing region. Further, the overshoot increases the amplitude of the oscillation electric field in the developing gap with the result that the toner 71 is caused to oscillate on the roller 75 more actively. This loosens the toner more positively.

Figure 10:
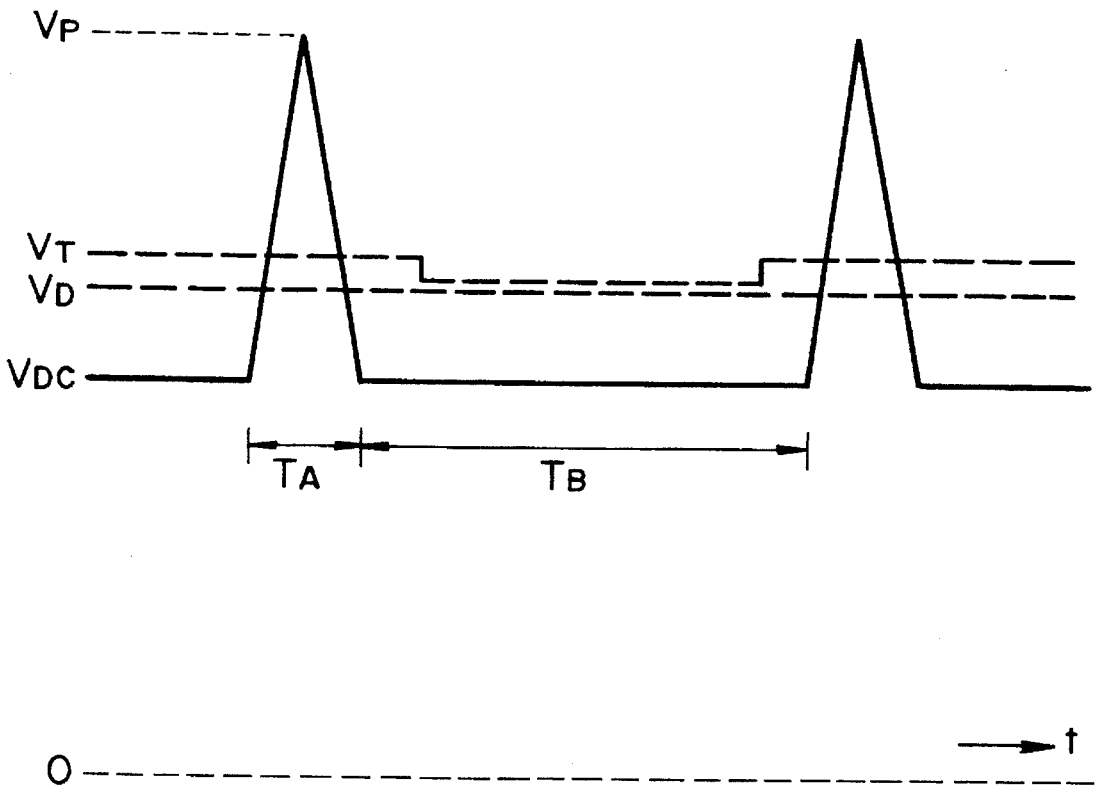

As shown in FIG. 10, the bias voltage $V_B$ for the second color may be implemented as a voltage having a triangular waveform and appearing during the period of time $T_A$, and the DC voltage $V_{DC}$ appearing in the following period of time TB. The triangular waveform voltage has a peak voltage $V_P$. The bias voltage $V_B$ including such a triangular waveform voltage has the following advantages. While the voltage is applied for the period of time $T_A$, the toner 71 of second color starts flying toward the drum 1 without regard to the image/non-image area. Subsequently, while the DC voltage $V_{DC}$ is applied over the period of time $T_B$, the toner 71 flown toward the image area of the drum 1 reaches the drum 1 while the toner 71 flown toward the non-image area is returned to the roller 75. When the triangular waveform voltage is applied for the period of time $T_A$, it lowers the effective voltage, compared to a pulse voltage having the same peak voltage $V_P$. As a result, the distance which the toner 71 flies from the roller 75 toward the non-image area of the drum 1 decreases, further reducing the possibility of background contamination. In addition, the toner 71 is caused to oscillate to insure a smooth image as in the case with a pulse voltage.

Moreover, the triangular waveform voltage simplifies the arrangement of the bias power source 77 since the positive- and negative-going edges thereof should only change at a low rate. In this connection, should the positive- and negative-going edges of the triangular waveform be slower than 5 V/μsec, the electric field for returning the toner 71 to the roller 75 would be late and allow it to reach the drum 1, resulting in background contamination. Preferably, therefore, the positive- and negative-going edges should each be sharper than 5 V/μsec.

Specific examples of the illustrative embodiment will be described hereinafter.

EXAMPLE 1

The photoconductive element 1 was implemented by a negatively chargeable organic photoconductor. The toners 41 and 71 of first and second colors, respectively, were negatively chargeable. Negative-to-positive development was performed by providing the second developing unit 7 with a developing gap of 0.18 mm, moving the drum 1 at a linear velocity of 120 mm/sec, and moving the developing roller 75 at a linear velocity 1.2 times as high as that of the drum 1. The potential $V_T$ of the toner image of first color was −800 V to −900 V. The potential $V_L$ of the latent image of second color was about −100 V while the background potential $V_D$ was about −910 V. The bias voltage $V_B$ had one period made up of a pulse voltage $V_{PULS}$ whose peak voltage was −1200 V and duration was 50 μsec, and a DC voltage $V_{DC}$ of −700 V; the voltage $V_B$ was repetitively applied at a frequency of 2 kHz.

In Example 1, the second image rendered a clear-cut line and a smooth halftone portion without disturbing the toner image of first color existing on the drum 1. Hardly any of the toner of first color 41 was introduced into the second developing unit 7.

EXAMPLE 21

Again, the photoconductive element 1 was implemented by a negatively chargeable organic photoconductor. The toners 41 and 71 of first and second colors, respectively, were negatively chargeable. Negative-to-positive development was effected by providing the second developing unit 7 with a developing gap of 0.18 mm, moving the drum 1 at a linear velocity of 200 mm/sec, and moving the developing roller 75 at a linear velocity 1.1 times as high as that of the drum 1. The potential $V_T$ of the toner image of first color was −800 V to −900 V. The potential $V_L$ of the latent image of second color was about −100 V while the background potential $V_D$ was about −910 V. The bias voltage $V_B$ had one period made up of a pulse voltage $V_{PULS}$ having a peak voltage of −1300 V, a duration of 60 μsec, and an overshoot portion whose peak voltage was −600 V and duration was 10 μsec, and a DC voltage $V_{DC}$ of −700 V; the voltage $V_B$ was repetitively applied to the drum 75 at a frequency of 2.5 kHz.

In Example 2, the second image also rendered a clear-cut line and a smooth halftone portion without disturbing the toner image of first color existing on the drum 1. Hardly any of the toner of first color 41 was introduced into the second developing unit 7.

EXAMPLE 3

The photoconductor of the drum 1 was implemented by selenium which was chargeable to a positive polarity. The toners 41 and 71 of first and second colors, respectively, were also positively chargeable. Negative-to-positive development was effected by providing the second developing unit 7 with a developing gap of 0.18 mm, moving the drum 1 at a linear velocity of 120 mm/sec, and moving the developing roller 75 at a linear velocity 1.2 times as high as that of the drum 1. The potential $V_T$ of the toner image of first color was +800 V to +900 V. The potential $V_L$ of the latent image of second color was about +100 V while the background potential $V_D$ was about +910 V. The bias voltage $V_B$ had one period made up of a triangular waveform voltage whose peak voltage was +1300 V and positive-and negative-going times were 100 μsec each, and a DC voltage $V_{DC}$ of +700 V; the voltage $V_B$ was repetitively applied to the roller 75 at a frequency of 2 kHz. Example 3 was comparable with Examples 1 and 2 in respect of advantage.

Figure 11:
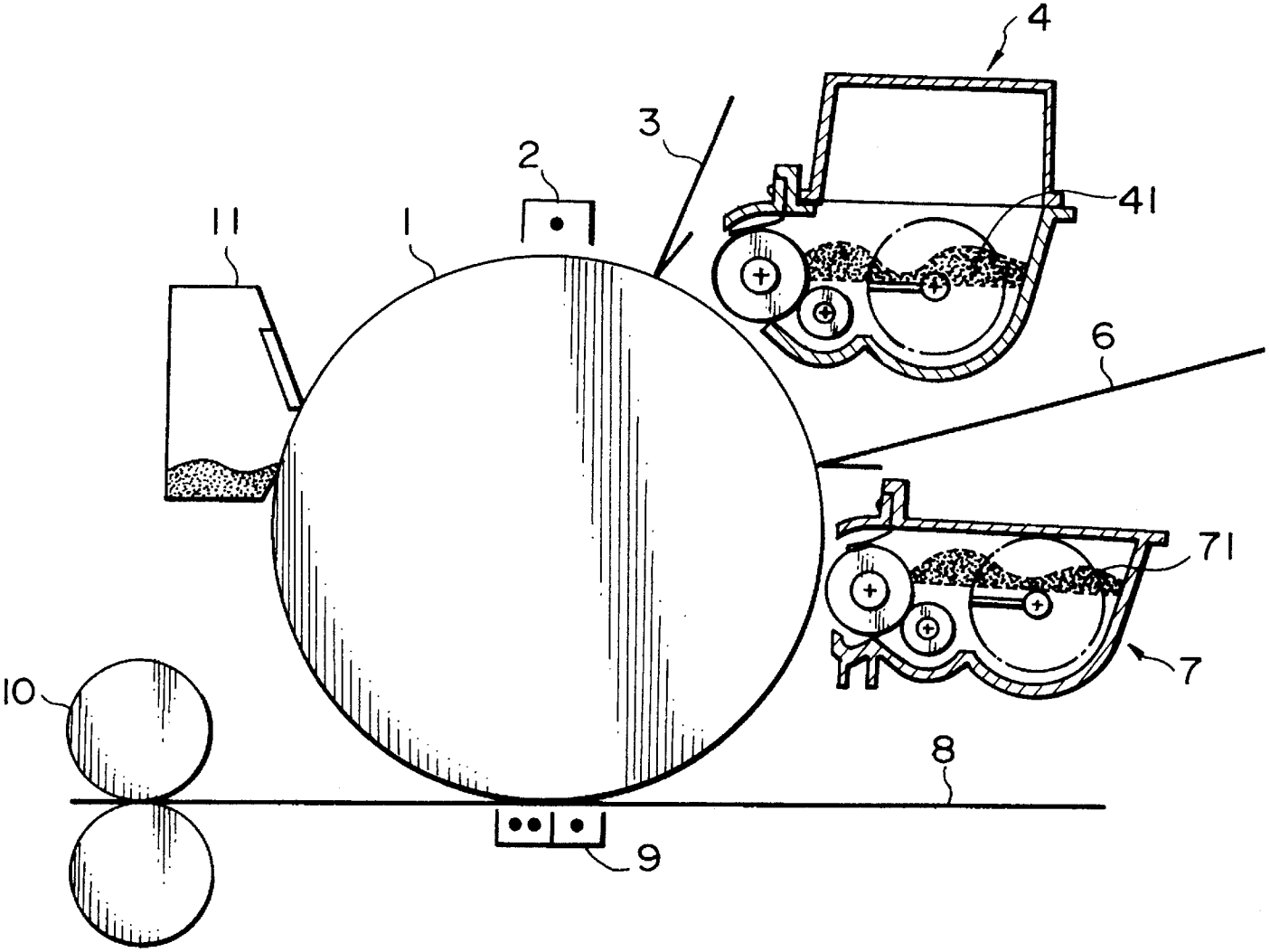
FIG. 11 is a section showing an alternative embodiment of the present invention.

Referring to FIG. 11, an alternative embodiment of the present invention will be described. In the FIG. 11, the same or similar constituents as or to the constituents shown in FIG. 1 are designated by the same reference numerals, and a detailed description thereof will not be made in order to avoid redundancy. In this embodiment, the toners 41 and 71 assigned to the first and second development, respectively, are opposite in polarity to each other. Specifically, for the development in the first color, the toner 41 of the same polarity as the charge of the drum 1 is used to effect negative-to-positive development. For the development in the second color, the toner 71 opposite in polarity to the charge of the drum 1 is used to effect positive-to-positive development.

Figure 12A:
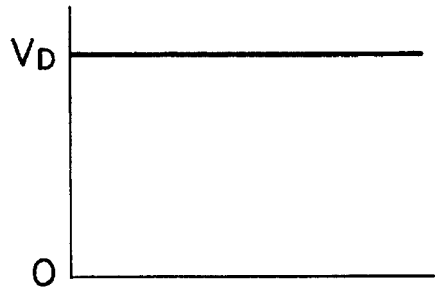
FIGS. 12A, 12B, 12C, 12D, and 12E are representative of a sequence of steps particular to the embodiment of FIG. 11.
Figure 12B:
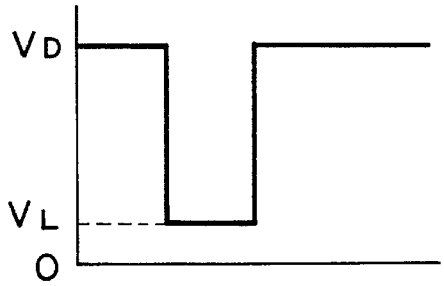
Figure 12C:
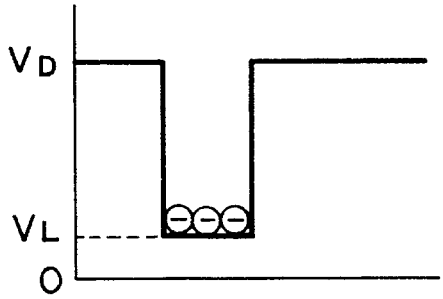
Figure 12D:
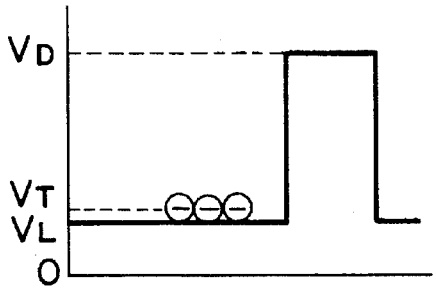
Figure 12E:
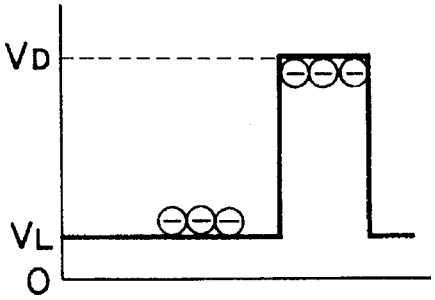

The operation of this embodiment will be outlined with reference to FIGS. 12A–12E as well as to FIG. 11. To begin with, as shown in FIG. 12A, the first charger 2 charges the surface of the drum 1 uniformly to a potential $V_D$. Then, the first exposing device 3 forms a first electrostatic latent image on the drum 1, as shown in FIG. 12B. At this instant, the drum 1 has the potential thereof lowered to $V_L$ at the first latent image. The first developing unit 4 develops the first latent image to form a corresponding toner image of first color on the drum 1, as shown in FIG. 12C. Subsequently, the second exposing device 6 forms an electrostatic latent image for the second or positive-to-positive development on the drum 1 without the intermediary of second charging, as shown in FIG. 12D. Finally, the second developing unit 7 develops the second latent image, as shown in FIG. 12E.

Figure 13:
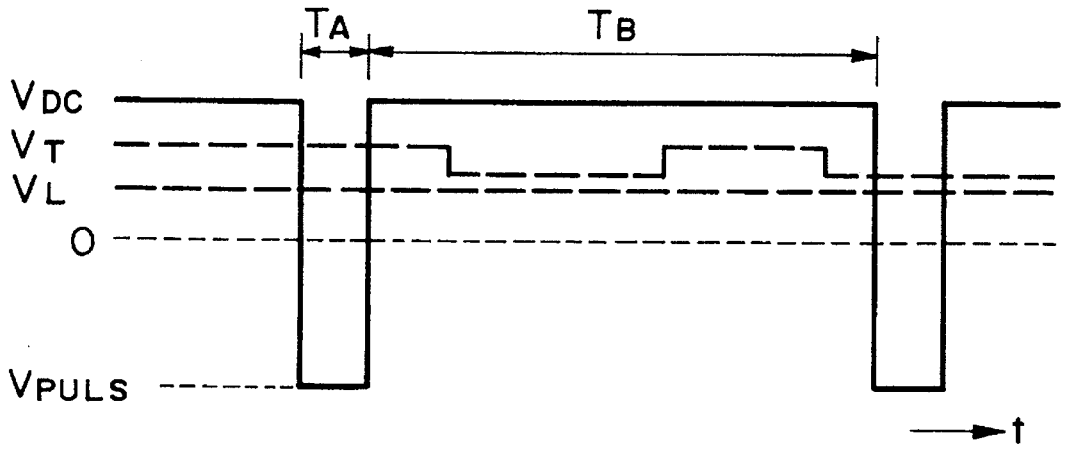
FIG. 13 shows the waveform of a bias voltage for development particular to the embodiment of FIG. 11.

FIG. 13 shows a specific bias voltage $V_B$ which the embodiment may apply when the second developing unit 7 develops the latent image with the developer 71. As shown, one period of the bias voltage $V_B$ is made up of a pulse voltage or first voltage $V_{PULS}$ whose duration (first period of time) is $T_A$, and a DC voltage $V_{DC}$ whose duration (second period of time) is $T_B$. In the FIG. 13, the abscissa is indicative of time. The pulse voltage $V_{PULS}$ is opposite in polarity to the potential $V_L$ of the non-image area and the potential $V_D$ of the image area of the drum 1 and so selected as to set up a sufficient developing potential in each of the two areas. On the other hand, the DC voltage $V_{DC}$ is selected to be higher in absolute value than the potential $V_T$ of the toner layer of first color and the potential $V_L$ of the non-image area of the drum 1 and lower in absolute value than the potential $V_D$ of the image area, thereby providing a sufficient developing potential.

In this embodiment, the pulse voltage $V_{PULS}$ has a duration shorter than 100 μsec. One period of the bias voltage $V_B$ is longer than 200 μsec, i.e., the repetition frequency of one period is lower than 5 kHz. Further, the developing gap lies in a range of from 100 μm to 300 μm.

In the above configuration, when the pulse voltage $V_{PULS}$ for development in the second color is applied to the roller 75. the toner 71 starts flying from the roller 75 toward the surface of the drum 1 without regard to the image/non-image area. In this condition, electric fields are distributed in the developing gap in the same manner as in FIG. 7A (although the direction is opposite). As a result, the intense electric field prevents the thickness of a line latent image on the drum 1 from being degraded. In addition, the toner 71 floated away from the roller 75 flies along the intense electric field faithfully, reproducing even thin lines accurately.

Figure 14:
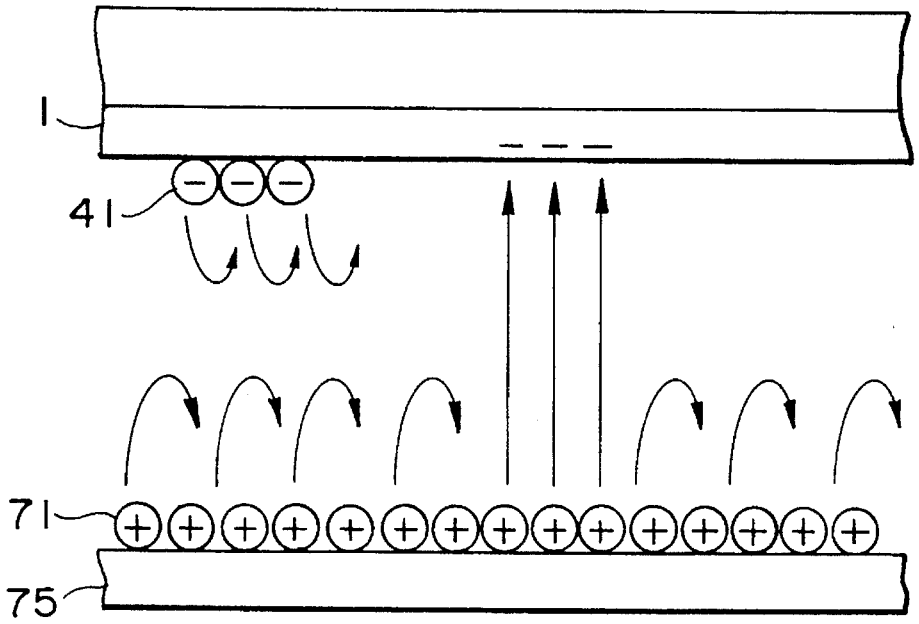
FIG. 14 shows how a toner flies in a developing gap in the embodiment of FIG. 11 when a DC voltage forming part of a bias voltage is applied.

In the illustrative embodiment, when the DC voltage $V_{DC}$ is applied to the roller 75, the toner 71 flown toward the non-image area of the drum 1 does not reach it, but it is returned to the roller 75, as shown in FIG. 14. At the same time, the toner 71 flown toward the image area of the drum 1 successfully reaches it and forms a toner image. In FIG. 14, the toners 71 and 41 are respectively representative of the toner layer of second color deposited on the roller 75 and the toner image of first color formed on the drum 1.

Another advantage achievable with this embodiment is that the toner 71 oscillates on the developing roller 75 and, therefore, become loose or untangled. As a result, a smooth image is formed even in low contrast portions.

In the event of development in the second color, the toner 71 is prevented from moving back and forth in the developing gap while hitting against the surface of the drum 1. The toner 71, therefore, does not disturb the toner image of first color existing on the drum 1. In addition, it is not likely that the toner of first color 41 leaves the drum 1 and flies into the developing unit 7 assigned to the second color 71.

The repetition frequency of the bias voltage is selected to be lower than 5 kHz, as stated earlier. Hence, when the toner 71 once floated away from the developing roller 75 is returned toward the roller 75, an electric field tending to cause the toner 71 to fly toward the drum 1 is eliminated which would cause it to cloud the developing gap. This is successful in rendering a sharp image.

The developing gap is greater than 100 μm, as also stated earlier. This further prevents the toner of second color 71 from arriving at the non-image area of the drum 1 and, therefore, surely protects the background from contamination. Since the developing gap is smaller than 300 μm, it is not likely that the formation of an electric field for development becomes difficult to render an image unclear.

In this embodiment, during the period of time $T_A$, an electric field tending to cause the toner of first color 41 to fly from the drum 1 back to the roller 75 acts. However, even such a part of the toner 41 is returned to the drum 1 without reaching the roller 75.

If desired, the bias voltage $V_B$ may be replaced with one including an overshoot portion (duration of TC) in the negative-going edge of the pulse voltage $V_{PULS}$, or one including a triangular waveform voltage whose peak value is $V_P$ in the period of time $T_A$, as in the previous embodiment.

Specific examples of the alternative embodiment will be described hereinafter.

EXAMPLE 4

The photoconductor of the drum 1 was implemented by a negatively chargeable organic photoconductor. The toner 41 was negatively chargeable and used to effect negative-to-positive development in the first color. The toner 71 was positively chargeable and used to effect positive-to-positive development in the second color. The development in the second color was effected by providing the second developing unit 7 with a developing gap of 0.16 mm, moving the drum 1 at a linear velocity of 120 mm/sec, and moving the developing roller 75 at a linear velocity 1.1 times as high as that of the drum 1. The potential $V_T$ of the toner image of first color was −110 V to −160 V. The potential $V_D$ of the latent image of second color was about −850 V while the background potential $V_L$ was about −100 V. The bias voltage $V_B$ had one period made up of a pulse voltage $V_{PULS}$ whose peak voltage was +250 V and duration was 50 μsec, and a DC voltage $V_{DC}$ of −250 V; the voltage $V_B$ was repetitively applied to the roller 75 at a frequency of 2 kHz.

In Example 4, the second image rendered a clear-cut line and a smooth halftone portion without disturbing the toner image of first color existing on the drum 1. Hardly any of the toner of first color 41 was introduced into the second developing unit 7.

EXAMPLE 5

The photoconductor of the drum 1 was implemented by a negatively chargeable organic photoconductor. The toner 41 was negatively chargeable and used to effect negative-to-positive development in the first color. The toner 71 was positively chargeable and used to effect positive-to-positive development in the second color. The development in the second color was effected by providing the second developing unit 7 with a developing gap of 0.16 mm, moving the drum 1 at a linear velocity of 120 mm/sec, and moving the developing roller 75 at a linear velocity 1.1 times as high as that of the drum 1. The potential $V_T$ of the toner image of first color was −110 V to −160 V. The potential $V_D$ of the latent image of second color was about −850 V while the background potential $V_L$ was about −100 V. The bias voltage $V_B$ had one period made up of a pulse voltage $V_{PULS}$ having a peak voltage of +250 V, a duration of 50 μsec, and an overshoot portion whose peak voltage was −400 V and duration was 20 μsec at the negative-going edge, and a DC voltage $V_{DC}$ of −250 V; the voltage $V_B$ was repetitively applied to the drum 75 at a frequency of 2 kHz.

In Example 5, the second image also rendered a clear-cut line and a smooth halftone portion without disturbing the toner image of first color existing on the drum 1. Hardly any of the toner of first color 41 was introduced into the second developing unit 7.

It is to be noted that the conditions of the illustrative embodiment, of course, hold in combination with the predetermined polarity of the drum 1, i.e.. whatever the polarity of the charge to deposit on the toner may be.

The embodiment is practicable both when the toners 41 and 71 are chargeable to the same polarity and effect negative-to-positive development and when the toners 41 and 71 are chargeable to opposite polarities to each other and effect negative-to-positive and positive-to-positive development, respectively.

The embodiment has concentrated on the developing unit 7 performing non-contact development with the roller 75 which is made up of the conductive resin **75*b* and dielectric particles 75*c* buried therein to increase the amount of toner deposition. However, the embodiment is similarly applicable to a multicolor image forming apparatus having a developing unit which performs non-contact development with a developing roller lacking the conductive resin 75*b* or similar conductor and the dielectric particles 75*c*** or similar dielectric portions.

In summary, it will be seen that the present invention provides an image forming apparatus having various unprecedented advantages, as enumerated below.

(1) Thin lines can be faithfully reproduced on an image carrier without having the thinness thereof degraded.

(2) The background of an image is protected from contamination.

(3) A developer layer existing on the surface of the image carrier is not disturbed by the following developer.

(4) A smooth image is reproduced even in portions where contrast is low.

(5) A developer of first color is prevented from being mixed with a developer of second color.

(6) A sharp image is insured.

(7) The arrangement of bias voltage applying means is simplified.

(8) A developer floated away from a developer carrier toward the non-image area of the image carrier is surely prevented from reaching the image carrier.

Various modifications will become possible for those skilled in the art after receiving the teachings of the present disclosure without departing from the scope thereof.

What is claimed is:

1. A multicolor image forming apparatus for forming a multicolor visible image on an image carrier and then transferring said multicolor visible image to a transfer medium at a time, said apparatus comprising:

first developing means for developing a latent image with a developer of first color; and second developing means for developing a latent image with a developer of second color;

said second developing means comprising:

a developer carrier for depositing said developer of second color thereon; and bias voltage applying means for applying to said developer carrier a bias voltage for development which changes periodically and has one period made up of a first period of time and a second period of time;

wherein said bias voltage applying means applies, during said first period of time, a first voltage comprising a pulse voltage generating an electric field which causes said developer of second color to fly toward an image area and a non-image area of said image carrier in a gap between said image carrier and said developer carrier and applies, during said second period of time, a second voltage comprising a DC voltage generating, in said gap, an electric field returning said developer of second color having flied toward said non-image area during said first period of time to said developer carrier while preventing said developer of first color existing on said image carrier from leaving said image carrier, said first period of time being selected such that said developer of second color does not reach said non-image area and said developer of first color existing on said image carrier does not fly to said developer carrier.

2. An apparatus as claimed in claim 1, wherein said second voltage is selected such that a difference between said second voltage and a potential of said developer of first color existing on said image carrier is smaller than 500 V in absolute value;

said first period of time being shorter than 100 μsec;

said one period of said bias voltage having a repetition frequency of lower than 5 kHz;

the gap between said developer carrier and said image carrier lying in a range of from 100 μm to 300 μm.

3. An apparatus as claimed in claim 1, wherein said pulse voltage has an overshoot portion at a negative-going edge thereof, a difference between a peak voltage of said overshoot portion and said DC voltage being greater than 50 V.

4. An apparatus as claimed in claim 1, wherein said first voltage comprises a voltage having a triangular waveform.

5. An apparatus as claimed in claim 4, wherein said first voltage having a triangular waveform changes at a rate of higher than 5 V/μsec at a positive-going and a negative-going edge thereof.

6. A multicolor image forming apparatus for forming a multicolor visible image on an image carrier and then transferring said multicolor visible image to a transfer medium at a time, said apparatus comprising:

first developing means for developing a latent image with a developer of first color;

second developing means for developing a latent image with a developer of second color;

said second developing means comprising:

a developer carrier for depositing said developer of second color thereon; and bias voltage applying means for applying to said developer carrier a bias voltage for development which changes periodically and has one period made up of a first period of time and a second period of time;

wherein said bias voltage applying means applies, during said first period of time, a first voltage comprising a pulse voltage generating an electric field which causes said developer of second color to fly toward an image area and a non-image area of said image carrier in a gap between said image carrier and said developer carrier and applies, during said second period of time, a second voltage comprising a DC voltage generating, in said gap, an electric field returning said developer of second color having flied toward said non-image area during said first period of time to said developer carrier while preventing said developer of first color existing on said image carrier from leaving said image carrier, and the first period of time is selected such that the developer of second color does not reach the non-image area, and the second voltage is selected such that the developer of first color deposited on the image carrier does not fly to said developer carrier.

7. An apparatus as claimed in claim 6, wherein said second voltage is selected such that a difference between said second voltage and a potential of said developer of first color existing on said image carrier is smaller than 500 V in absolute value;

said first period of time being shorter than 100 μsec;

said one period of said bias voltage having a repetition frequency of lower than 5 kHz;

the gap between said developer carrier and said image carrier lying in a range of from 100 μm to 300 μm.

8. An apparatus as claimed in claim 6, wherein said pulse voltage has an overshoot portion at a negative-going edge thereof, a difference between a peak voltage of said overshoot portion and said DC voltage being greater than 50 V.

9. An apparatus as claimed in claim 6, wherein said first voltage comprises a voltage having a triangular waveform.

10. An apparatus as claimed in claim 9, wherein said first voltage having a triangular waveform changes at a rate of higher than 5 V/μsec at a positive-going and a negative-going edge thereof.

11. A multicolor image forming apparatus for forming a multicolor visible image on an image carrier and then transferring said multicolor visible image to a transfer medium at a time, said apparatus comprising:

first developing means for developing a latent image with a developer of first color; and second developing means for developing a latent image with a developer of second color;

said second developing means comprising:

a developer carrier for depositing said developer of second color thereon, and bias voltage applying means for applying to said developer carrier a bias voltage for development which changes periodically and has one period made up of a first period of time and a second period of time, wherein said bias voltage applying means applies, during said first period of time, a first voltage generating an electric field which causes said developer of said second color to fly toward an image area and a non-image area of said image carrier in a gap between said image carrier and said developer carrier and applies, during said second period of time, a second voltage generating, in said gap, an electric field returning said developer of said second color having flied toward said non-image area during said first period of time to said developer carrier, said first period of time being selected such that said developer of said second color does not reach said non-image area.

12. An apparatus as claimed in claim 11, wherein said second voltage generates an electric field preventing said developer of said first color existing on said image carrier from leaving said image carrier.

13. An apparatus as claimed in claim 11, wherein said first period of time is selected such that said developer of said first color existing on said image carrier does not fly to said developer carrier.

* * * * *